US008556073B2

(12) United States Patent
Liang

(10) Patent No.: US 8,556,073 B2
(45) Date of Patent: Oct. 15, 2013

(54) CARRIERS FOR CARRYING FASTENERS FOR FASTENER DRIVING TOOLS

(75) Inventor: Chien-Chain Liang, Shanghai (CN)

(73) Assignee: Jaaco Corporation, Redmond, WA (US)

( * ) Notice: Subject to any disclaimer, the term of this patent is extended or adjusted under 35 U.S.C. 154(b) by 0 days.

(21) Appl. No.: 13/283,115

(22) Filed: Oct. 27, 2011

(65) Prior Publication Data

US 2012/0103845 A1 May 3, 2012

Related U.S. Application Data

(60) Provisional application No. 61/409,251, filed on Nov. 2, 2010.

(51) Int. Cl.
*B65D 85/24* (2006.01)

(52) U.S. Cl.
USPC ..... 206/346; 411/443

(58) Field of Classification Search
CPC ..... F16B 15/08; F16B 27/00
USPC ..... 206/345, 346, 347, 343; 411/443
See application file for complete search history.

(56) References Cited

U.S. PATENT DOCUMENTS

| | | | | |
|---|---|---|---|---|
| 4,932,821 | A * | 6/1990 | Steffen et al. | 411/442 |
| 5,069,340 | A * | 12/1991 | Ernst et al. | 206/347 |
| 5,836,732 | A | 11/1998 | Gupta et al. | |
| 5,931,622 | A * | 8/1999 | Gupta et al. | 411/443 |
| 6,892,922 | B2 * | 5/2005 | Tucker et al. | 227/136 |
| D605,016 | S * | 12/2009 | Jin | D8/70 |

* cited by examiner

*Primary Examiner* — David Fidei
(74) *Attorney, Agent, or Firm* — Chen Yoshimura LLP

(57) ABSTRACT

A carrier for use in fastener driving tools, i.e. tools for driving fasteners such as nails into concrete, steel or other materials. In use, a carrier which carries multiple fasteners is loaded into the fastener driving tool. The carrier disclosed in this disclosure can be used with fastener driving tools of many different brands and models. The carrier includes multiple sleeves connected together by connecting parts. Each sleeve has an upper breakable collar, a middle wall portion, and a lower collar. The outer cross section of the lower collar has a substantially circular shape; the outer cross section of the upper collar has a near-rectangular shape. The upper collar has a smaller thickness than the lower collar, which enables the carrier to fit into and be used with fastener driving tools of different brands and models. The carrier is made of a plastic material such as high density polyethylene.

6 Claims, 3 Drawing Sheets

CARRIERS FOR CARRYING FASTENERS FOR FASTENER DRIVING TOOLS

This application claims priority under 35 USC §119(e) from U.S. Provisional Patent Application No. 61/409,251, filed Nov. 2, 2010, which is herein incorporated by reference in its entirety.

BACKGROUND OF THE INVENTION

1. Field of the Invention

This invention relates to a fastener assembly including a row of fasteners such as nails maintained in position by a carrier.

2. Description of the Related Art

Tools for driving fasteners such as nails into a receiving material such as concrete, steel, and so on have been widely used in construction, building and other industries. The pins can be used to attach fixtures to walls, ceilings, etc. of a building. Typically, multiple fasteners are carried by a carrier, the carrier is loaded into the tool, and the tool drives the fasteners into the receiving material. One such carrier is described in U.S. Pat. No. 5,836,732.

Many companies make such fastener driving tools. Typically, carriers for loading the fasteners into the tools are designed specifically for particular brands and models of fastener driving tools.

SUMMARY OF THE INVENTION

An object of the present invention is to provide a fastener carrier which can be loaded into and used with fastener driving tools of different models.

Additional features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, the present invention provides a fastener carrier for carrying a plurality of fasteners to be used with fastener driving tools, the carrier including: a plurality of sleeves; and a plurality of connecting parts connecting the plurality of sleeves side by side, wherein each sleeve comprises: a lower collar; an upper collar having a near-rectangular outer cross section in a plane perpendicular to a longitudinal direction of the sleeve which has two straight sides, wherein a thickness of the upper collar defined by a distance between the two straight sides is smaller than a thickness of the lower collar; and a middle wall connecting the upper collar and the lower collar.

It is to be understood that both the foregoing general description and the following detailed description are exemplary and explanatory and are intended to provide further explanation of the invention as claimed.

DETAILED DESCRIPTION OF THE PREFERRED EMBODIMENTS

Figure 1A:
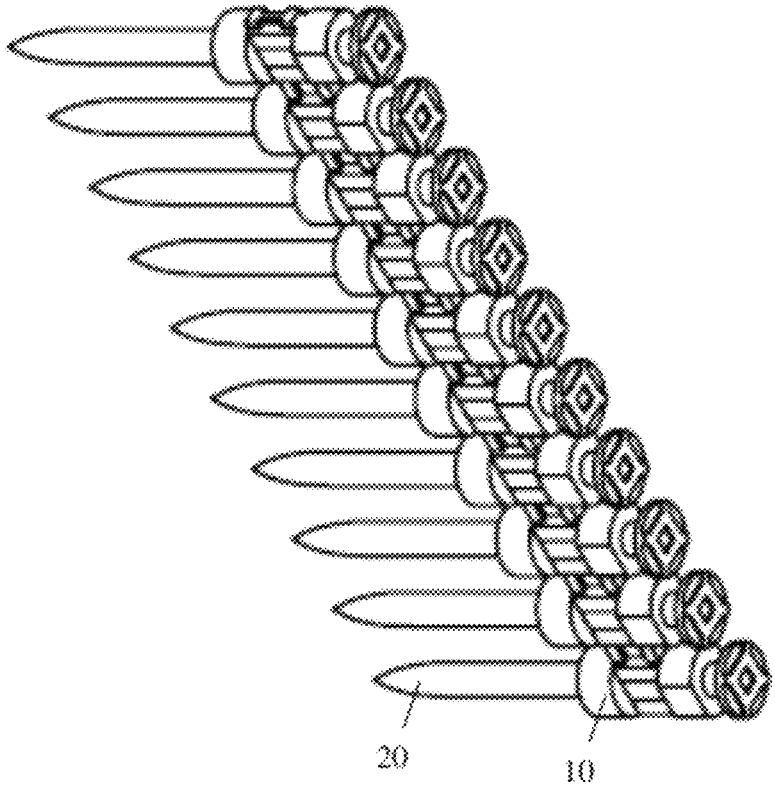
FIGS. 1A, 1B, 1C and 1D are perspective, front, side and top views, respectively, of a fastener carrier with fasteners according to an embodiment of the present invention.
Figure 1B:
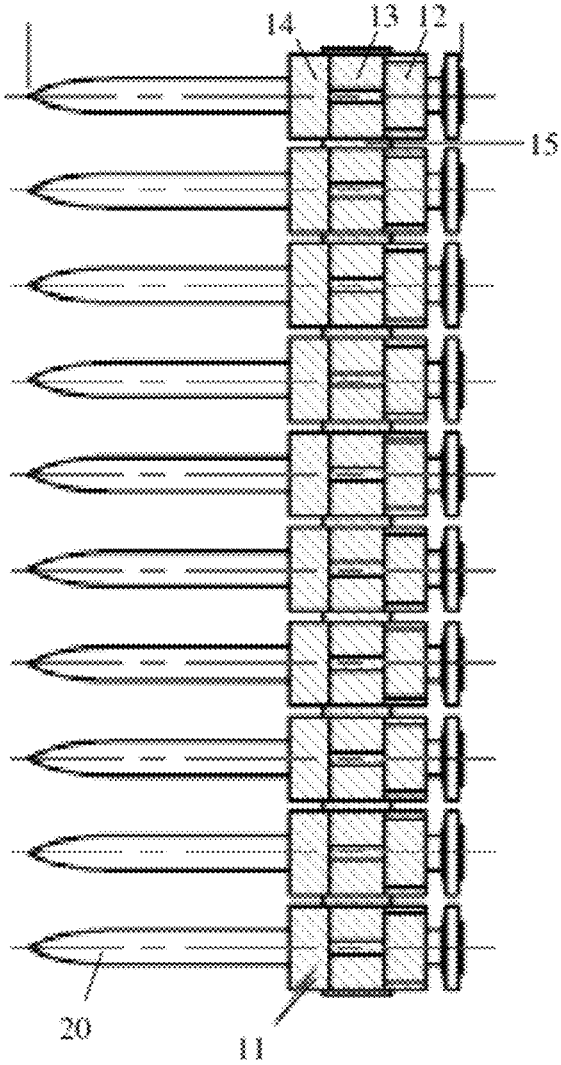
Figure 1D:
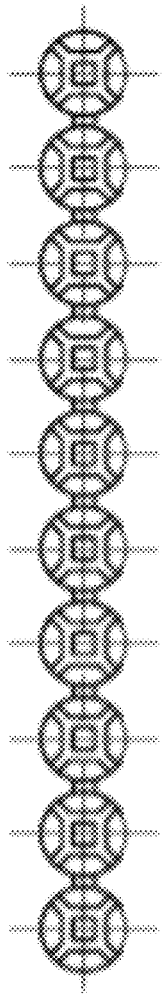
Figure 1C:
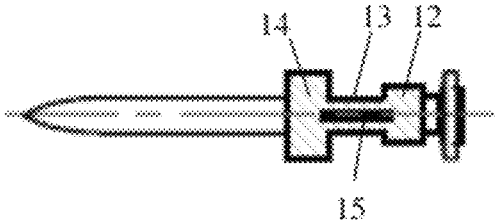

FIGS. 1A, 1B, 1C and 1D are perspective, front, side and top views, respectively, of a fastener carrier 10 carrying fasteners 20 (e.g., nails, also referred to as pins) according to an embodiment of the present invention. The pins are assembled together by the carrier to form a multiple-pin strip.

The carrier includes multiple (e.g. ten in the illustrated embodiment) sleeves 11 to hold the multiple pins in place respectively. Each sleeve has an upper breakable collar 12, a middle wall portion 13, and a lower collar 14. The upper collar is located closer to the head of the pin, the lower collar is located closer to the sharp end of the pin, and the middle wall portion connects the upper collar and the lower collar. The multiple sleeves 11 are connected together side by side by connecting parts 15.

The carrier is made of a plastic material. In a preferred embodiment, the plastic material is high density polyethylene (PHDP), and does not include any filler. The material enables the upper breakable collar to break away when the pin is driven into the receiving material by the tool. Preferably, the multiple sleeves 11 and the connecting parts 15 are formed integrally from the same material.

Both the upper and lower collars have a square-shaped interior cross section (in a plane perpendicular to the axis of the pin) which slidably grips the pins. In one embodiment, the four sides of the square are oriented at 45 degrees relative to the front side of the carrier.

The outer cross section of the lower collar 14 has a substantially circular shape. The outer cross section of the upper collar 12 has a near-rectangular shape, which is formed by two straight sides in the front and back sides, and two arcs (or other suitable shapes) on the left and right sides. The front straight sides of all sleeves are located in the same plane; the back straight sides of all sleeves are located in the same plane. Viewed from the front (see FIG. 1B), the upper collar 12 has the same dimension (referred to as the width) as the lower collar 14. Viewed from the side (see FIG. 1C), the upper collar 12 has a substantially smaller thickness (as defined by the distance between the two straight sides) than the thickness of lower collar 14 (i.e. the diameter of the lower collar). The smaller thickness of the upper collar 12 is an important factor that helps the carrier to fit into and be used with fastener driving tools of different brands and models.

Figure 2:
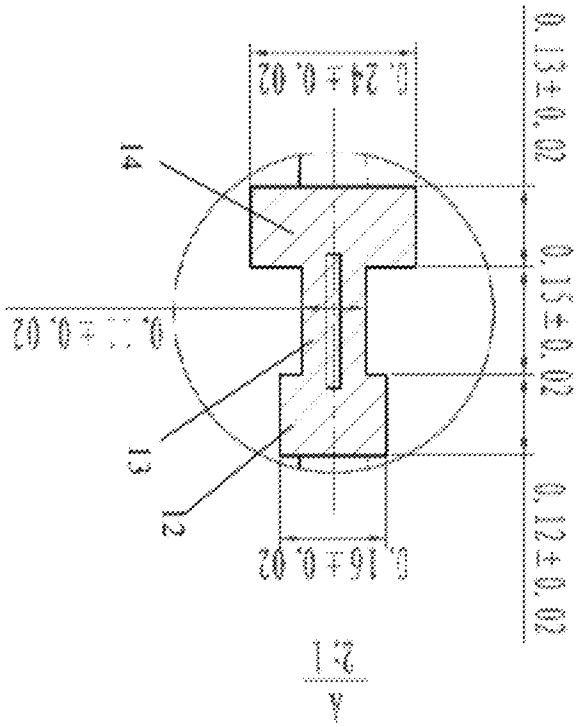
FIG. 2 is a side view showing the dimensions of a carrier according to one particular embodiment of the present invention.

FIG. 2 (side view) show the dimensions of a carrier or sleeve according to one particular embodiment of the invention. As seen in this figure, the thickness of the upper collar 12 is 0.16 inches; the thickness or diameter of the lower collar 14 is 0.24 inches; the thickness of the middle wall portion 13 is 0.11 inches; the height (in the longitudinal direction of the pin) of the upper collar is 0.12 inches; the height of the lower collar is 0.13 inches; and the height of the middle wall portion is 0.15 inches. All of the above figures are approximate; the tolerance allowed for these figures is about 0.02 inches. This particular carrier can be used with at least the following brands and models of faster driving tools: Ramset Trakfast 1100, Powers Trak-It C3/C3 ST, Hitachi NC 40G, Max GS865E, Simpsons GCN150, TyRex TY150GSC, and BeA CN60-688ES. In addition to the specific dimensions shown in FIG. 2, the upper collar may have other suitable thicknesses.

The shape of the middle wall portion 13 is not critical as long as it adequately connects the upper collar and the lower collar. In the illustrated embodiments, the middle wall portion has two parts located on two sides of the pin, and is thinner than the upper and lower collars. The shape of the connecting parts 15 is not critical as long as it adequately connects two sleeves to each other.

It will be apparent to those skilled in the art that various modification and variations can be made in the fastener carrier of the present invention without departing from the spirit or scope of the invention. Thus, it is intended that the present invention cover modifications and variations that come within the scope of the appended claims and their equivalents.

What is claimed is:

1. A fastener carrier for carrying a plurality of fasteners to be used with fastener driving tools, comprising:

a plurality of sleeves; and a plurality of connecting parts connecting the plurality of sleeves side by side, wherein each sleeve comprises:

a lower collar;

an upper collar having a near-rectangular outer cross section in a plane perpendicular to a longitudinal direction of the sleeve which has two straight sides, wherein a thickness of the upper collar defined by a distance between the two straight sides is smaller than a thickness of the lower collar, wherein both the upper collar and the lower collar have square-shaped interior cross sections in respective planes perpendicular to the longitudinal direction of the sleeve for slidably gripping the fasteners; and a middle wall connecting the upper collar and the lower collar.

2. The fastener carrier of claim 1, wherein the sleeves and the connecting parts are made of a plastic material.

3. The fastener carrier of claim 2, wherein the plastic material is high density polyethylene without any filler.

4. The fastener carrier of claim 2, wherein the sleeves and the connecting parts are formed integrally from the plastic material.

5. The fastener carrier of claim 1, wherein the lower collar has a circular outer cross section and its thickness is defined by its diameter.

6. The fastener carrier of claim 1, wherein the thickness of the upper collar is about 0.16 inches and the thickness of the lower collar is about 0.24 inches.

* * * * *